United States Patent [19]

Shanin

[11] 4,210,332

[45] Jul. 1, 1980

[54] PUZZLE DEVICE INCLUDING POLYHEDRONS AND SUPPORT STRUCTURE THEREFOR

[76] Inventor: Steven R. Shanin, 6460 N. Lincoln Ave., Highland Park, Ill. 60645

[21] Appl. No.: 927,002

[22] Filed: Jul. 24, 1978

[51] Int. Cl.[2] ..... A63F 9/12

[52] U.S. Cl. ..... 273/157 R

[58] Field of Search ..... 273/157 R, 241

[56] References Cited

U.S. PATENT DOCUMENTS

| | | | |
|---|---|---|---|
| 2,773,690 | 12/1956 | Housley | 273/241 |
| 2,886,325 | 5/1959 | Long | 273/241 X |
| 3,771,795 | 11/1973 | Flanigen | 273/157 R |
| 3,845,959 | 11/1974 | Kosarek | 273/153 S |
| 3,930,651 | 1/1976 | Rader | 273/241 |

FOREIGN PATENT DOCUMENTS

| | | | |
|---|---|---|---|
| 675678 | 7/1952 | United Kingdom | 273/157 R |
| 699546 | 11/1953 | United Kingdom | 273/241 |

*Primary Examiner*—Anton O. Oechsle

*Attorney, Agent, or Firm*—Larson, Taylor and Hinds

[57] ABSTRACT

A puzzle device includes a support structure and a plurality of polyhedrons, preferably cubes of equal size. The support structure, which may be a rectangular parallelepiped in shape, has a plurality of compartments located at its outer surface, such as at the four vertical sides, of the support structure. The compartments are adjacent one another and are open and unobstructed at the outer surface of the support structure to permit insertion into and removal of the cubes. On inserting the cubes into an appropriate compartment, the outer faces of the cubes together form at least a portion of each of the outer four vertical faces of the structure. Each of the cubes has a plurality of faces with different visual characteristics. By placing the cubes in an appropriate compartment and with the appropriate face outermost, the outer faces of the cubes together form a pre-determined visual effect, such as a picture or a pattern, at the outer surface of the structure. The pre-determined visual effect may constitute a single picture or the like which extends over the entire outer surface made up by the outer cube faces, or may be made into several distinct pictures of the like, such as one for each face or side of the support structure which is provided with compartments and cubes. The cubes can be rearranged in the support structure to give different visual effects. For example, using cubes, it is possible to provide, in a support structure having compartments on four vertical sides, four completely different visual arrangements and, in this embodiment, the visually depicted material on each cube may be unique with respect to all other cubes. If each vertical face has a distinct picture or pattern, a total of sixteen different visual effects, one for each face of the structure, can be provided by rearranging the individual cubes.

16 Claims, 4 Drawing Figures

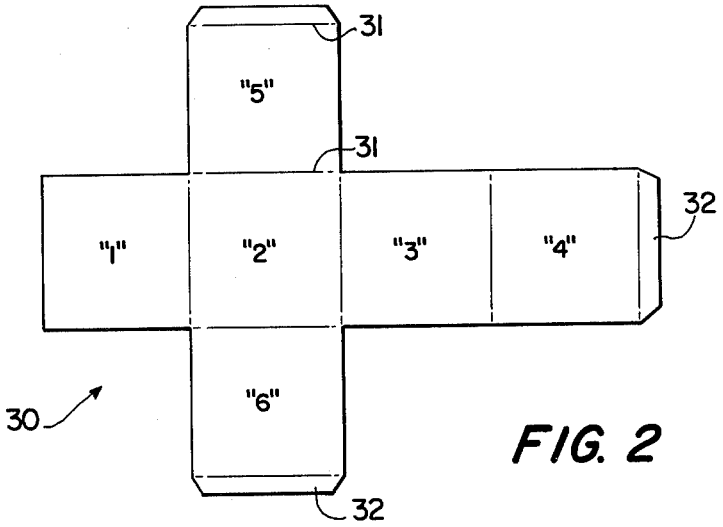
FIG. 2
FIG. 3
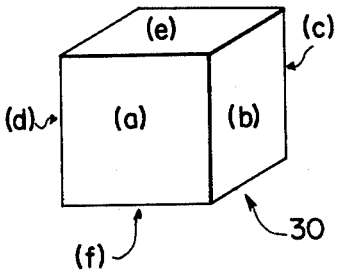
FORMAT IA
| | | |
|---|---|---|
| 1 | 2 | 3 |
| 4 | 5 | 6 |
| 7 | 8 | 9 |
| 10 | 11 | 12 |
| 13 | 14 | 15 |
FIG. 4

PUZZLE DEVICE INCLUDING POLYHEDRONS AND SUPPORT STRUCTURE THEREFOR

FIELD OF THE INVENTION

The present invention relates to a puzzle, game or amusement device of the type in which polyhedrons, such as cubes, are rearrangeable to form different predetermined visual effects such as pictures and patterns. The term "puzzle" is used in a broad sense to include games or amusement devices.

There are many types of these devices which are described in the prior art. Representative U.S. Pat. Nos. include: Fields, 498,639; Wooster, 1,518,889; Parks, 1,964,007; Flanigen, 3,771,795; and May, 4,021,939. While each of these prior art puzzles involves the arrangement of cubes or the like to form various pictures or designs, the present invention is quite different from each as will be apparent from the description and claims which follow.

BRIEF SUMMARY OF THE INVENTION

A puzzle, game or amusement device in accordance with the invention includes a support structure and a plurality of polyhedrons each of which has a plurality of faces having different visual characteristics. The support structure has a plurality of individual compartments located at the outer surface of the support structure, the compartments being adjacent to one another, and being open and unobstructed at the outer surface of the support structure to permit insertion into and removal from each compartment of a polyhedron. Each compartment includes wall means for separating adjacent compartments from one another and for supporting a respective polyhedron thereon. Each polyhedron is sized and shaped so as to be insertable into a respective compartment, the outer faces of the polyhedrons together forming an outer face of the support structure. The polyhedrons are arrangeable in the support structure in a plurality of arrangements in each of which the outer faces of the polyhedrons together form a predetermined visual effect on the outer surface of the support structure.

BRIEF DESCRIPTION OF THE DRAWINGS

FIG. 2 is a plan view of a blank useful to make a cube used in connection with the support structure of FIG. 1.

FIG. 3 is a perspective view of a cube made from the blank of FIG. 2.

FIG. 4 is a diagrammatic representation of a picture format to be used in fabricating a puzzle device in accordance with the invention.

DETAILED DESCRIPTION

Figure 1:
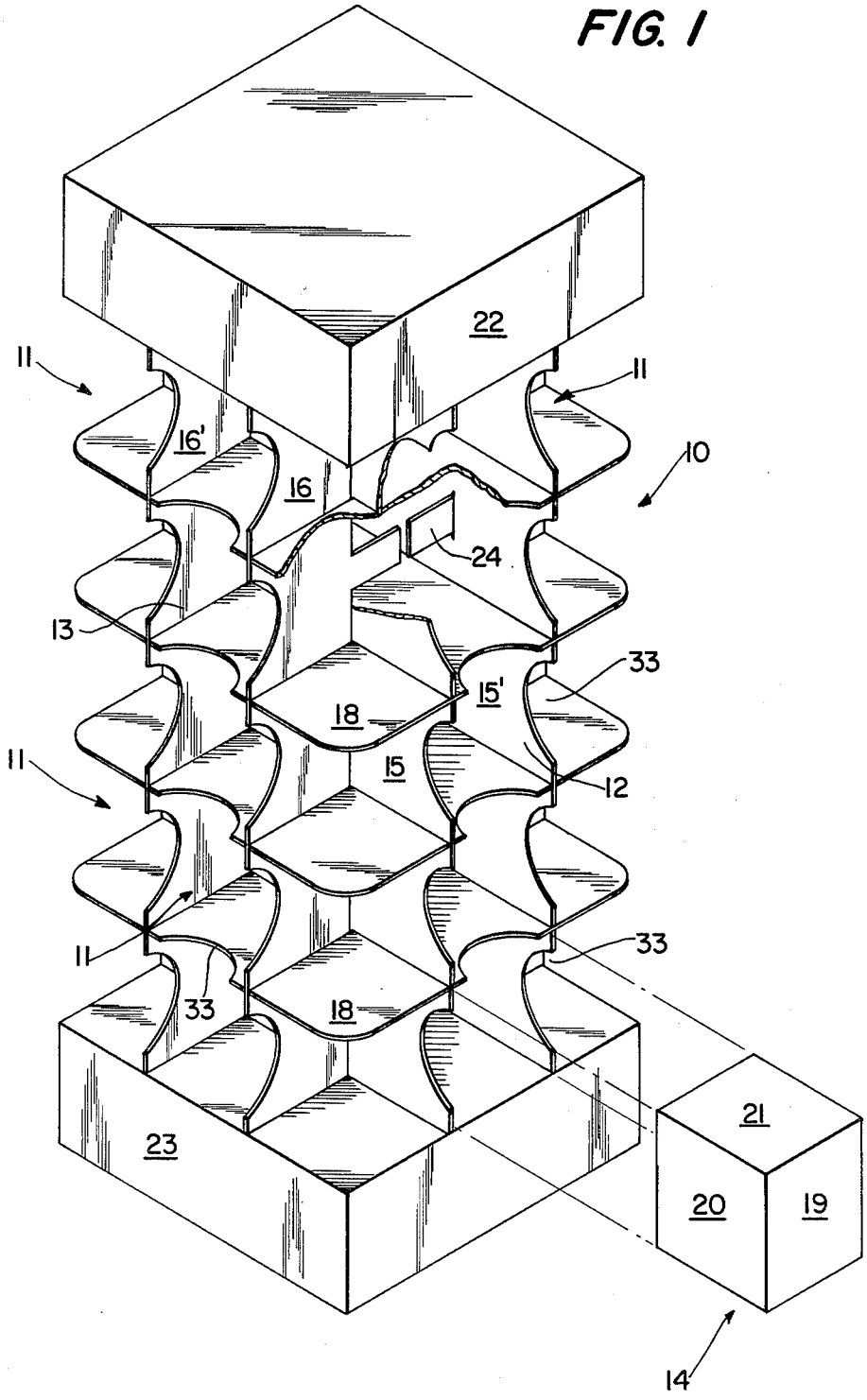
FIG. 1 is a perspective view of a support structure in accordance with the invention.

With reference to FIG. 1, a support structure 10 in accordance with the invention may be fabricated of any suitable material such as paperborad, cardboard, plastic, or the like. The structure is provided with forty individual compartments 11 located at the outer surface 12 of the support structure. The term "surface" is used in this context to mean the plane encompassing the various faces of the structure. In the area of compartments 11, this plane is imaginary whereas at the top and bottom of the structure, as well as at the upper and lower portions of each side face of the structure, the plane is coextensive with the material used to form the structure.

Individual compartments 11 are located adjacent one another and are open and unobstructed at the outer surface of the support structure to permit insertion into, and removal from, each compartment of a polyhedron 14. The structure includes six wall members (15, 15', 16, 16', 17 shown) and four floor members 18 forming wall means for separating adjacent compartments from one another and for supporting a respective polyhedron in each compartment.

Forty polyhedrons 14, only one of which is shown, are provided for the support structure of FIG. 1 and each has a size and shape such that it is insertable into a respective compartment 11 such that the outer faces of the polyhedrons inserted in the compartments together form an outer surface (e.g. 12, 13) of the support structure. Each of the polyhedrons has a plurality of faces (19, 20, 21 shown) having different visual characteristics such as a geometrical pattern or portion thereof. The polyhedrons are arrangeable in the support structure in a plurality of different arrangements in each of which the outer faces of the polyhedrons form a pre-determined visual effect at the outer surface of the support structure.

In a preferred embodiment, the support structure is a rectangular parallelepiped, square in cross-section, such as shown in FIG. 1 and has an enclosed top portion or cover 22 and a bottom portion or base 23 with cubical compartments 11 of equal size arranged only on the four elongate vertical sides or faces of the structure for receiving cubes 14.

The structure itself as well as the polyhedrons can be fabricated of any appropriate material such as plastic, cardboard, paperboard and the like. Paperboard or lightweight cardboard is preferred and the support structure of FIG. 1 can be easily fabricated therefrom by providing two identical blanks for top portion 22 and bottom portion 23, four identical blanks for the four floors 18, two identical blanks for main wall members 15, 15', and four identical blanks for secondary wall members 16, 16', 17, and a fourth parallel to wall 17 but hidden in FIG. 1. The structure is assembled by positioning main wall members 15, 15' parallel to one another and then inserting the four floor members 18 into slots formed in the wall members. The floor members include mating slots. Each adjacent slot in each wall member 15, 15' alternates in direction. For example, the slots in members 15, 15' for the uppermost floor member 18 begin at the front edge (side 12) as shown in FIG. 1 and the two mating slots in the top floor member begin at the rear of the floor member in the sense of FIG. 1. Thus, the uppermost floor 18 is inserted from the front (side 12) to the rear in the sense of FIG. 1. The slots for the next floor below begin at the rear edges of wall members 15, 15' and that floor member is thus inserted from the rear towards the front in the sense of FIG. 1. Each floor 18 has four additional slots, two at the edge along surface 13 of the structure, and two at its opposite edge, all for engaging the secondary well members. Secondary well members 16, 16', 17 and a fourth not shown each include mating slots at their inner (in the sense of FIG. 1) edges, one slot for each floor, and each member is placed in the structure by insertion inwards after the mating slots of the floor members and secondary wall members are aligned. Each secondary wall member is also provided with a plurality of tabs 24 at their inner ends which tabs extend through slots provided in main wall members 15, 15' for the purpose. The tabs are sized such that they provide a rear wall for those compartments formed between main wall members 15, 15' on side 12 and the opposite side of the device.

The polyhedrons are preferably cubes and are preferably arranged in compartments in horizontal and vertical rows on each of the four vertical sides of the support structure between top and bottom portions of the support structure. In this manner, using a structure with forty compartments as shown in FIG. 1, it is possible to achieve four distinctly different arrangements or visual effects on the outer surface of the device, each arrangement including the four vertical sides of the structure, using a single set of forty cubes, one for each compartment. If each arrangement or set-up includes a distinctly different visual effect, such as a picture, on each of the four sides, a total of sixteen completely different pictures or designs is achieved. In this instance, the visual matter provided on each of the cubes may be unique with respect to all other cubes and it will be recognized that it will be possible to provide a puzzle with an extraordinarily high degree of difficulty which can be made the more difficult or easier by choice of visual effect.

An illustration of a device with forty cubes, as shown in FIG. 1, follows.

The cubes themselves are preferably made of paperboard or the like and may be made from a blank 30, shown in FIG. 2, having conventional score lines 31 and glue tabs 32. There are forty cubes, each having six faces, for a total of 240 faces. Each arrangement, or "set-up", in which each of the forty cubes occupies one of the forty compartments, uses sixty faces. Four arrangements or "set-ups" can thus be made without using any face twice. Each cube face and each cube may thus be unique.

In each set-up, the cubes at the end of each horizontal row have one face exposed in the row in question and an adjacent face exposed in a horizontal row. The central cubes in each row have only one face exposed. Thus, in each set-up, twenty cubes have two faces exposed and twenty cubes have one face exposed. Accordingly, in order to use each cube, each must be used twice as an end cube and twice as a central cube. This can be illustrated by focussing attention on a single horizontal row of three cubes. Assume that the faces of each is numbered as follows: front—1; right side—2; rear side—3; left side—4; top—5; bottom—6. Identify the left cube as A, center B, right C. In a first set-up, faces A1, B1, and C1 form a first visual effect on one side of the device. Face A4 and C2 are used to form a portion of first visual effects on the two adjacent sides of the device. Cubes A1, B1 and C1 are then rotated 180° about a vertical axis to form a second, different, set-up on the same side of the device and made up of faces A3, B3, and C3. Faces A2 and C4 are used to form a portion of second visual effects on the two adjacent sides of the device.

At this point, each of the twenty "end" cubes of the device has two opposite "unused" faces and each of the twenty center cubes has four adjacent and unused faces. To provide two further set-ups, each end cube is moved to a center compartment and each center cube is moved to an end compartment. Again, focussing attention on a horizontal row of three cubes, the left end cube is moved to the center and face A5 exposed, the center cube is moved to the right end and arranged such that face B2 is exposed on the side in question and face B6 is exposed on the adjacent, right, side of the device. A third block, b, previously used as the center block on the adjacent left side of the device, is moved over to form the left end block. Face b2 is exposed on the side in question and face b5 is exposed on the adjacent, left, side of the device. Block C is moved to form the center block of the adjacent, right, side of the device, with face C5 exposed for that purpose. The third set-up on the side in question is now made up of (from left to right) face b2, A5, and B2. The fourth set-up is made by rotating each block 180° to expose faces b4, A6 and B4 on the side in question with faces b6 and B5 used in the adjacent left side and right side arrangements, respectively.

It will be seen from the foregoing that four set-ups are possible. Since each side can include a distinct visual display, such as a picture, it will be apparent that sixteen distinct visual formats may be provided from a single set of cubes equal in number to the number of compartments of the device, and that each cube, and even each face of each cube, may be unique. While the individual visual items on each side may be separate and distinct, they may be related, such as in the case of front, rear and side views of an object or person. The assembled puzzle may also be a model of a house or other building in which case the top portion of the device may simulate a roof or the like. Other visual relationships will be readily apparent such as pictures of individuals belonging to groups such as recording groups or performers such as "Charile's Angels." Of course, geometrical or other patterns may be used.

It will be recognized that the mathematical possibilities of the puzzle device are very high. Accordingly, and particularly where the visual subject matter is complex, an extraordinary degree of difficulty in assembling the puzzle is possible. In this regard, it should be pointed out that it is not at all necessary, in fabricating the puzzle, to proceed in the orderly fashion mentioned above which focussed on three cubes in a horizontal row. In the embodiment illustrated in FIG. 1, it is required that each cube have two "single use" opposite faces and two "double use" adjacent faces, but the cubes can be moved about in any of several ways, even at random (bearing in mind the mentioned requirement). For example, the top left block on side 12, FIG. 1, can be used in a second format as the center block, third row, on side 13 and so on at random. The puzzle can, of course, be made simple by selection of format, distinguishing background colors, distinguishing framing, reduced number of cubes, or any or all of these techniques or others which will be well known to those having ordinary skill in the art.

While various techniques can be used to place the visual information on the device, it is preferred to mass-produce the device by printing on paperboard or the like and the following scheme may be utilized. A support structure such as that shown in FIG. 1 is fabricated, and forty cubes, made from paperboard blanks as shown in FIG. 2, are also made up. The cubes are then placed in the support structure. In this Example, sixteen individual pictures are to be provided on the cubes. The first set-up is designated I and includes four distinct pictures A, B, C, D, one for each of the four vertical sides A, B, C, D of the support structure.

It will facilitate matters if, for this explanation, designations "1" through "6" are assigned to each cube (FIG. 3) and it will be assumed that in format I, faces "1" all appear at front side A and rear side C of the device. Thus, considering the end cubes in the right side B and the left side D of the device, the cubes on the left ends of sides B and D have face "2" exposed, and the cubes on the right ends of sides B and D have face "4" exposed, and it will be assumed that side "1" of the center cubes is exposed.

Four pictures are selected for format I and will be identified as IA, IB, IC and ID, the letters indicating the side of the device on which the picture is to be depicted. FIG. 4 depicts the picture format IA. The overall size of the format is the same as that of side A of the support structure. The numbers 1 through 15 serve to represent visual format, both as to content and orientation, and to represent a grid pattern of squares each of which is the same size as that of each face of a cube 30. The picture is cut into the fifteen squares shown and each is secured, such as by glue, onto an exposed face "1" of each cube 30 in front side A of the support structure. The grid pattern is conveniently applied to the picture format by applying grid lines on the back of the picture. Each square in the grid is then given an identification, such as shown in FIG. 4, to facilitate securing the individual squares to the appropriate cube face in the support structure. The pictures are attached to the cubes in the order shown such that the depicted format is in the pre-determined sense depicted in FIG. 4. Thus, the format 1A, square number 1, is secured to the exposed face of the top left cube in side A of the support structure. Formats 1B, 1C and 1D are similarly provided on the right, rear, and left sides B, C, D of the device. The cubes are then moved as described above and a second format, IIA, is cut into fifteen squares as above and applied to the fresh exposed cube faces. Formats 11B, 11C, and 11D are provided in the same manner. The cubes are then moved again to provide the four pictures of format III and are moved one last time to provide the pictures of format III.

Each cube is then opened out flat as shown in FIG. 1. The cube is preferably readily openable, such as by a tab and slot arrangement, for this purpose. Each cube is preferably numbered for information purposes and a face, say face "1" identified, such that each may be readily identified, both for orientation and position in the device, by inspection. A code, in the form of inconspicuous edge markings, may be used for this purpose. Of course, the back side or tabs of the blank may also bear such identification.

Once the forty cube blanks are flattened out, they are preferably arranged in a logical sequence and then copies made by conventional printing techniques. Colored or other pictorial format is preferred and is readily printed by conventional photolithographic techniques. The printing is preferably effected onto partially cut cube blank material bearing score lines, tabs and the like in the appropriate places for folding the blank into a cube. In this manner, the entire puzzle, support structure and cubes can be provided in a flat package for assembly of the cubes and support structure from "push-out" paperboard materials.

In the illustrated embodiment, it will be recognized that the entire structure can be tipped over on its side. While this will place one of the picture formats downwardly, the same number of visual arrangements can be made, two on the vertical sides, one on the top, and one on the bottom. In this embodiment, it is necessary that steps be taken to prevent cubes from dropping out of the bottom side of the device. For this purpose, the cubes may be made a sufficiently tight fit between opposite wall members or floor members of the support structure. Where the material of construction of the support structure or cubes or both is not suited to this technique, positive securing means, such as small Velcro or snap fasteners may be used. These are particularly suited to geometrical visual effects since they can form a portion of a pattern.

It will be apparent that only the surface of the support structure is used to provide compartments for the polyhedrons. Thus, any portion of the volume of the device which is not used for surface compartments, such as the central "column," equivalent to the space of five cubical compartments, in the support structure of FIG. 1, does not form part of the visual format. The support structure therefore preferably includes means, such as tabs 24, to form compartments only at the surface of the support structure.

It is preferred to maximize the number of visual arrangements, or set-ups, that can be achieved and it is also preferred to use cubes, and cubical compartments. It is also preferred to provide a rectangular parallelepiped support structure and to utilize a number of cubes sufficient to render the puzzle challenging. A minimum number of fifteen cubes is thus preferred. In the most preferred embodiments, each face of each cube may be unique with respect to all other cube faces in visual format. Various arrangements can be used to achieve this result. For example, the height of the rectangular parallelepiped structure of FIG. 1 can be increased or decreased and the number of blocks increased or decreased to the same extent. It is also possible to provide quite unique arrangements in which five or six sides of a rectangular parallelepiped can be used to provide six individual visual formats. For example, a cubical structure having a total of eight compartments can provide, using eight cubes, two set-ups of six sides each for a total of twelve distinct visual formats. A structure with sixteen compartments, two high by two wide by four deep, will provide three set-ups of five faces each for a total of fifteen distinct visual formats using sixteen cubes. A structure with eighteen compartments, three high by three wide by two deep, can be used to make three set-ups of five faces each. In each of these arrangements, each individual cube face which is utilized in depicting visual format may be unique with respect to all others and each cube is used in forming the surface of the device in each set-up. Many other arrangements are possible. Several are disclosed in my application Ser. No. 927,003, entitled "PUZZLE DEVICE" filed July 24, 1978, the disclosure of which is herein incorporated by reference.

Another arrangement involves a parallelepiped using sixty two cubes arranged six high, three wide, and four deep. This can be used to provide two set-ups of five distinct formats each (top and four sides). The support structure also contains compartments on the bottom two of which are unoccupied. When turned on its side so as to be four compartments in height, six in width, and three in depth, sixty of the sixty two cubes originally used can be rearranged to provide two more set-ups of five formats each (top and four sides) with two cubes unused. Thus, the sixty two cubes provide twenty distinct formats, ten of which are provided with the support structure oriented vertically, the remaining ten being provided with the structure oriented horizontally.

As indicated above, it is preferred that the polyhedrons are cubes. However, other polyhedrons are possible, such as a regular tetrahedron, rectangular parallelepiped, prism, and the like. In the case of tetrahedrons, some means is ordinarily required to hold the polyhedrons in place in any vertical surface. Since the exposed face is triangular, the edges of any vertical or horizontal row of tetrahedrons will be jagged. It is thus preferred that a support structure having tetrahedron compartments to present a continuous surface, such as that of a sphere or cylinder. This would be particularly suitable for displaying visual formats of a spherical or cylindrical type, such as planets, silos, etc. Four different arrangements would, of course, be possible.

Rectangular, non-cubical, hexahedrons, as well as prisms and other shapes can also be used. Moreover, it is possible to use different sizes and/or shapes in a single device. For example, considering the device of FIG. 1, each horizontal row could be larger in a downward direction (like a pyramid) to accommodate larger cubes, three in each horizontal row as in FIG. 1. These can be rearranged to form sixteen visual formats as in the embodiment illustrated in FIG. 1. However, rearrangement of a given cube is limited to the level in which it is located, and it is preferred that the edges of adjacent polyhedrons on the picture format are contiguous so that the visual matter is presented in a smooth and uninterrupted plane.

It is preferred that, where the support structure is a polyhedron as in the embodiment of FIG. 1, the end or "corner" compartments are open at the corners where a horizontal row of compartments on one face of the support adjoins another. Thus, as shown in FIG. 1, there is preferably no wall structure at the corners and the format of the faces of a corner cube meets the format of the adjoining face at the cube edge. Of course, a support structure can be provided at the corners if desired in which case it is positioned and arranged so as not to interfere with insertion or removal of a polyhedron. Insertion and removal of polyhedrons is also facilitated by providing indented portions 33 (FIG. 1) in the wall members and floor members.

It will be apparent that several other arrangements are possible.

What is claimed is:

1. A puzzle device comprising: a support structure, said support structure comprising a plurality of individual compartments located at the outer surface of said support structure, the compartments being adjacent to one another, and being open and unobstructed at the outer surface of said support structure to permit insertion into and removal from each compartment of a polyhedron, each compartment comprising wall means for separating adjacent compartments from one another and for supporting respective polyhedrons therein, said support structure including a central space equivalent to the space of at least one of said compartments; and a plurality of polyhedrons equal in number to the number of said surface compartments, each polyhedron having a size and shape such that each is insertable into a respective compartment such that, on inserting the polyhedrons into said compartments, the outer faces of said polyhedrons together form an outer surface of said support structure, each polyhedron having a plurality of faces and having different visual characteristics, the polyhedrons being arrangeable in said support structure in a plurality of arrangements in each of which at least one face of each polyhedron is visible at an outer surface of said support structure in each of said arrangements, and in each of which the outer faces of the polyhedrons together form a pre-determined visual effect at said outer surfce of the support structure, each face of each polyhedron being useful in only one arrangement to form a pre-determined visual effect, all faces of all polyhedrons being used once to form said plurality of arrangements.

2. A puzzle device according to claim 1 wherein said support structure comprises a top portion, a bottom portion, and an side portion comprising a plurality of said compartments.

3. A puzzle device according to claim 2 wherein said support structure comprises a rectangular parallelepiped having four outer side faces.

4. A puzzle according to claim 3 wherein said four outer side faces are each rectangular.

5. A puzzle according to claim 1 wherein each polyhedron has the same size and shape.

6. A puzzle according to claim 5 wherein said support structure comprises a top portion, a bottom portion, and a side portion comprising a plurality of said compartments.

7. A puzzle according to claim 6 wherein said support structure comprises a rectangular parallelepiped having four planar outer side faces.

8. A puzzle according to claim 7 wherein each outer side face has at least one horizontal row of three compartments, each end compartment of each horizontal row forming the end compartment of an adjacent horizontal row of compartments of an adjacent side portion of said support structure.

9. A puzzle according to claim 8 wherein each of said polyhedrons is a cube of the same size.

10. A puzzle according to claim 9 wherein the visual characteristics of each cube is unique.

11. A puzzle according to claim 10 wherein the visual format of each face of each cube is unique.

12. A puzzle according to claim 1 wherein said wall means comprises vertical and horizontal walls separating adjacent compartments, said vertical and horizontal walls having indented regions along their outer edges to facilitate removal of a polyhedron therefrom.

13. A puzzle according to claim 2 wherein said top and bottom portions of said support structure each comprise a cover member covering the upper and lower compartments of the support structure.

14. A puzzle according to claim 2 wherein said compartments are provided at least at said side portion and said top portion of said support structure.

15. A puzzle according to claim 2 wherein said compartments are provided at said top, bottom and side portions of said support structure.

16. A puzzle according to claim 4 wherein each outer side portion comprises at least three horizontal rows of three compartments each, each end compartment of each row forming the end compartment of an adjacent horizontal row of the compartments of an adjacent side face of said support structure.

* * * * *